US006116819A

United States Patent [19]

England

[11] Patent Number: 6,116,819

[45] Date of Patent: Sep. 12, 2000

[54] AUGER PILING

[75] Inventor: Melvin Gerrard England, Middlesex, United Kingdom

[73] Assignee: Kvaerner Cementation Fondations Ltd., Rickmansworth, United Kingdom

[21] Appl. No.: 09/011,239

[22] PCT Filed: Jul. 30, 1996

[86] PCT No.: PCT/GB96/01855

§ 371 Date: May 28, 1998

§ 102(e) Date: May 28, 1998

[87] PCT Pub. No.: WO97/05334

PCT Pub. Date: Feb. 13, 1997

[30] Foreign Application Priority Data

Jul. 31, 1995 [GB] United Kingdom ..... 9515652

[51] Int. Cl.[7] ..... E02D 5/34

[52] U.S. Cl. ..... 405/241; 405/240; 405/233

[58] Field of Search ..... 405/240, 241, 405/242, 248, 233, 232, 231, 230, 221, 236, 243

[56] References Cited

U.S. PATENT DOCUMENTS

| | | | |
|---|---|---|---|
| 3,200,599 | 8/1965 | Phares et al. . | |
| 3,300,988 | 1/1967 | Phares et al. | 405/241 |
| 4,042,043 | 8/1977 | Appleman . | |
| 4,433,943 | 2/1984 | Pao Chen | 405/241 |
| 4,958,962 | 9/1990 | Schellhorn | 405/267 |
| 5,002,435 | 3/1991 | Dupeuble | 405/241 |
| 5,099,696 | 3/1992 | Yabuuchi | 405/233 |
| 5,542,786 | 8/1996 | Blum | 405/241 |

FOREIGN PATENT DOCUMENTS

| | | | |
|---|---|---|---|
| 878 215 | 3/1979 | Belgium . | |
| 0008919 | 1/1991 | Japan | 405/241 |
| 954 842 | 4/1964 | United Kingdom . | |
| 2 064 623 | 6/1981 | United Kingdom . | |

*Primary Examiner*—Eileen D. Lillis
*Assistant Examiner*—Frederick L Lagman
*Attorney, Agent, or Firm*—Browdy and Neimark, P.L.L.C.

[57] ABSTRACT

There is disclosed a method of continuous flight auger piling and a continuous flight auger rig (1), wherein an auger (2) is applied to the ground so as to undergo a first, penetration phase and a second, withdrawal phase, and wherein the rotational speed of and/or the rate of penetration of and/or the torque applied to the auger (2) during the first, penetration phase are determined and controlled as a function of the ground conditions and the auger geometry by means of an electronic computer (8) so as to tend to keep the auger flights loaded (11) with soil originating from the region of the tip of the auger (2). During the withdrawal phase, concrete (14) may be supplied to the tip (12) of the auger (2) by way of flow control and measuring means (6, 7), the rate of withdrawal of the auger (2) being controlled as a function of the flow rate of the concrete (14), or vice versa, by means of an electronic computer (8) so as to ensure that sufficient concrete (14) is supplied to keep at least the tip (12) of the auger (2) immersed in concrete (14) during withdrawal.

20 Claims, 5 Drawing Sheets

AUGER PILING

This invention relates to auger piling, and in particular, but no exclusively, to the automation of the digging and piling phases of continuous flight auger piling operations.

Continuous flight auger piling has been used in the construction industry since the early 1980s. Piles are constructed by drilling to the required depth with a continuous flight auger mounted on a piling rig, withdrawing the auger, and pumping concrete into the excavation through the auger as the auger is withdrawn. A reinforcement cage may subsequently be placed in the wet concrete.

Reliable installation of the pile is influenced by a number of factors. A first consideration is that the ground surrounding the excavation should not be overly disturbed. A second consideration is that sufficient concrete should be delivered through the auger so as to prevent ingress of soil from the walls of the excavation which would otherwise contaminate the concrete cross-section.

With reference to the first of these considerations, it is possible to insert a continuous auger into the ground merely by rotating it with sufficient torque. Under these conditions, lateral displacement of the surrounding soil compacts the soil material, resulting in increased resistance against rotation until the resistance matches the applied torque. At this point refusal occurs, that is, the auger is no longer able to rotate and no further penetration can be achieved. If, at refusal, the auger tip has achieved the required depth and the piling rig is able to withdraw the loaded auger, then it would be possible to deliver the concrete in a straightforward manner. In practice, however, the depth of penetration achieved in this way is rarely sufficient. In order to achieve greater depths, it is possible to limit the rate of penetration of the auger so that soil on the auger flights is gradually sheared from the soil surrounding the excavation.

An auger turning in a soil where there is no peripheral friction will not transport soil upwards and will be very inefficient. An auger turning in a soil with a high angle of friction (this is where the vertical component of the shear force between soil on an auger flight relative to soil comprising the bore wall is large compared to the horizontal component) will have little lateral pressure available from the soil and will therefore be an inefficient transporter. However, an auger turning in a loose sand, for example, is subject to a high lateral soil pressure and will be an efficient transporter. If the penetration rate of the auger in such a soil is not fast enough to keep the auger flights fully loaded from the digging action, the auger will load material by inward failure of the bore wall and cause considerable disturbance to the surrounding ground.

With reference now to the second consideration, namely the delivery of concrete through the auger, it is possible to monitor the concrete feed by determining the concrete pressure in the feed pipe at a suitable location, for example at the top of the auger. A pile may then be installed by maintaining a positive concrete pressure as the auger is withdrawn. This assumes that no additional concrete can be delivered to the void vacated by the withdrawing auger. However, not all ground conditions allow this method to operate reliably. In particular, in badly consolidated soils which allow concrete to escape to the surface, pressure monitoring becomes meaningless. In addition, spoil can block the hole through which the concrete is supplied and result in positive pressure readings although an insufficient amount of concrete is being delivered. Furthermore, the concrete pressure readings are dependent on whether the auger is rotated during withdrawal, since the reading will be reduced if concrete is continually transported up the auger flights. Accordingly, pressure monitoring by itself is not a good technique for controlling pile installation, nor does it provide a good indication of a successfully installed pile.

In order to address these difficulties, it has been proposed, for example in U.S. Pat. No. 3,200,599, to measure the volume of concrete delivered by way of counting the strokes made by the concrete pump. However, such pumps generally propel a volume in the region of 25 liters per stroke, which is a very coarse measure. Furthermore, most concrete pumps employ a non-return valve which is required to close so that the piston can reload with fresh concrete. Consequently, the speed at which the valve closes is critical to the volume of concrete delivered with the next stroke. This means that the volume delivered with each stroke can vary by ±10% or more.

According to a first aspect of the present invention, there is provided a method of continuous flight auger piling, wherein:

i) an auger is applied to the ground so as to undergo a first, penetration phase and a second, withdrawal phase; and ii) the rotational speed of and/or the rate of penetration of and/or the torque applied to the auger during the first, penetration phase are determined and controlled as a function of the ground conditions and the auger geometry by means of an electronic computer so as to tend to keep the auger flights loaded with soil originating from the region of the tip of the auger.

According to a second aspect of the present invention, there is provided a continuous flight auger rig comprising an auger, means for driving the auger into the ground, means for measuring and controlling the rotational speed of and/or the rate of penetration of and/or the torque applied to the auger as it penetrates the ground, and electronic computer means for controlling the rotational speed of and/or the rate of penetration of and/or the torque applied to the auger as a function of the ground conditions and the auger geometry so as to tend, in use, to keep the auger flights loaded with soil originating from the region of the tip of the auger.

By balancing the various penetration parameters with reference to the ground conditions, the present invention improves the digging efficiency over known systems which relay on trail and error. Furthermore, by reducing the disturbance to the soil comprising the bore wall, the skin friction available for the eventual pile is increased, and the volume of concrete required for piling is reduced, since less concrete escapes into the surrounding soil.

In some embodiments of the present invention, the auger is driven in such a way that the auger penetrates the ground to a predetermined depth, at which depth the advance of the auger is arrested in order to allow shearing of soil surrounding the bore wall to take place. The auger is then permitted to advance again before penetration is again arrested. This procedure may be repeated until the desired depth is reached.

Advantageously, the electronic computer means and auger control means are arranged to control the stepwise advance of the auger in order to achieve a specific predetermined number of auger revolutions per meter of penetration. It is possible to achieve very fine control of the auger by this means, enabling thereby almost continuous penetration at the desired rate of advance. In contrast, conventional manual control permits only coarse stepwise advancement of the auger.

By determining the maximum torque available from the auger rig by, for example, measuring the hydraulic pressure in the drive mechanism when the rig is stalled, it is possible to ensure that the auger is not allowed to advance when ground conditions are such that the maximum torque is developed. This helps to prevent the auger from reaching a stage in which it becomes stuck in the ground with no excess torque available to initiate soil shearing.

According to a third aspect of the present invention, there is provided a method of continuous flight auger piling, wherein:

i) an auger is applied to the ground so as to undergo a first, penetration phase and a second, withdrawal phase;

ii) concrete is supplied to the tip of the auger during the second, withdrawal phase by way of flow control and measuring means; and iii) the rate of withdrawal of the auger is controlled as a function of the flow rate of the concrete, or vice versa, by means of an electronic computer so as to ensure that sufficient concrete is supplied to keep at least the tip of the auger immersed in concrete during withdrawal.

According to a fourth aspect of the present invention, there is provided a continuous flight auger rig comprising an auger, means for driving the auger into the ground, means for withdrawing the auger from the ground, means for supplying concrete to the tip of the auger during withdrawal, means for measuring and/or controlling the supply of concrete to the ground, and electronic computer means for controlling the auger during at least the withdrawal phase of its operation so as to ensure that at least the tip of the auger remains immersed in concrete during withdrawal.

By controlling the rate of withdrawal of the auger as a function of the concrete supply, or vice versa, and through knowledge of the diameter of the auger, it is possible to calculate and supply the minimum theoretically-required volume of concrete to form a structurally sound pile. In general, however, a predetermined degree of over-supply is specified in order to provide additional structural soundness. Advantageously, the over-supply is at least 5%, preferably between 10 to 35%, greater than the theoretical minimum. The actual value adopted in any instance will be governed principally by ground conditions at the site of operation, as will be appreciated by those skilled in this art. Over-supply of concrete helps to ensure that the excavation is filled to capacity and compensates for minor disturbances introduced into the soil surrounding the bore wall. As opposed to known systems, however, the present invention provides accurate control over the volume of concrete supplied and avoids the wastage which is inherent in the systems of the prior art. It is important to keep the tip of the auger immersed in concrete during the withdrawal phase in order to prevent inward failure of the bore wall leading to the concrete of the resulting pile becoming contaminated with soil.

Advantageously, the concrete supply is measured by way of an electromagnetic flowmeter, preferred examples of which may provide a resolution of ±1 $dm^3$ to an absolute accuracy of approximately ±5%. In practice, the nature of the aggregate in the concrete gives rise to this degree of variation in the accuracy of measurement.

In a preferred embodiment, the means for withdrawing the auger comprises a hydraulic rig incorporating an electronically-controlled hydraulic valve. This is in contrast to existing systems in which withdrawal of an auger is achieved through a manual lifting control valve operated by the rig operator. By linking the hydraulic valve to the electronic computer means, which in turn is connected to the flowmeter, it is possible to control the rate of withdrawal of the auger and the flow rate of the concrete interdependently according to a predetermined regime. In particular, feedback of data from the flowmeter may be used to control the hydraulic valve in order to adjust the withdrawal rate and vice versa. Certain embodiments of the invention incorporating this feedback mechanism are capable of providing a degree of control such that the volume of concrete actually delivered is with 5%, preferably within 2%, of the theoretically specified volume. This target volume may be adjusted at any time during delivery in order to take into account varying ground conditions. In addition, it is possible to detect interruptions to the concrete delivery and halt the concreting phase automatically until the supply of concrete is resumed. This is in contrast to known systems in which control is entirely dependent on the skill and reaction time of the operator.

According to a fifth aspect of the present invention, there is provided a method of continuous flight auger piling, wherein:

i) an auger is applied to the ground so as to undergo a first, penetration phase and a second, withdrawal phase; and ii) the rotational speed of and/or the rate of penetration of and/or the torque applied to the auger during the first, penetration phase are determined and controlled as a function of the ground conditions and the auger geometry by means of an electronic computer so as to tend to keep the auger flights loaded with soil originating from the region of the tip of the auger;

iii) concrete is supplied to the tip of the auger during the second, withdrawal phase by way of an electromagnetic flowmeter and flow control means; and iv) the rate of withdrawal of the auger is controlled as a function of the flow rate of the concrete, or vice versa, by means of an electronic computer so as to ensure that sufficient concrete is supplied to keep at least the tip of the auger immersed in concrete during withdrawal.

According to a sixth aspect of the present invention, there is provided a continuous flight auger rig comprising an auger, means for driving the auger into the ground, means for measuring and controlling the rotational speed of and/or the rate of penetration of and/or the torque applied to the auger as it penetrates the ground, electronic computer means for controlling the rotational speed of and/or the rate of penetration of and/or the torque applied to the auger as a function of the ground conditions and the auger geometry so as to tend, in use, to keep the auger flights loaded with soil originating from the region of the tip of the auger, means for withdrawing the auger from the ground, means for supplying concrete to the tip of the auger during withdrawal, means for controlling the supply of concrete to the ground, an electromagnetic flowmeter for measuring the volume of concrete supplied, and electronic computer means for controlling the auger during the withdrawal phase of its operation so as to ensure that at least the tip of the auger remains immersed in concrete during withdrawal.

For a better understanding of the present invention, and to show how it may be carried into effect, reference will now be made, by way of example, to the accompanying drawings, in which.

Figure 1:
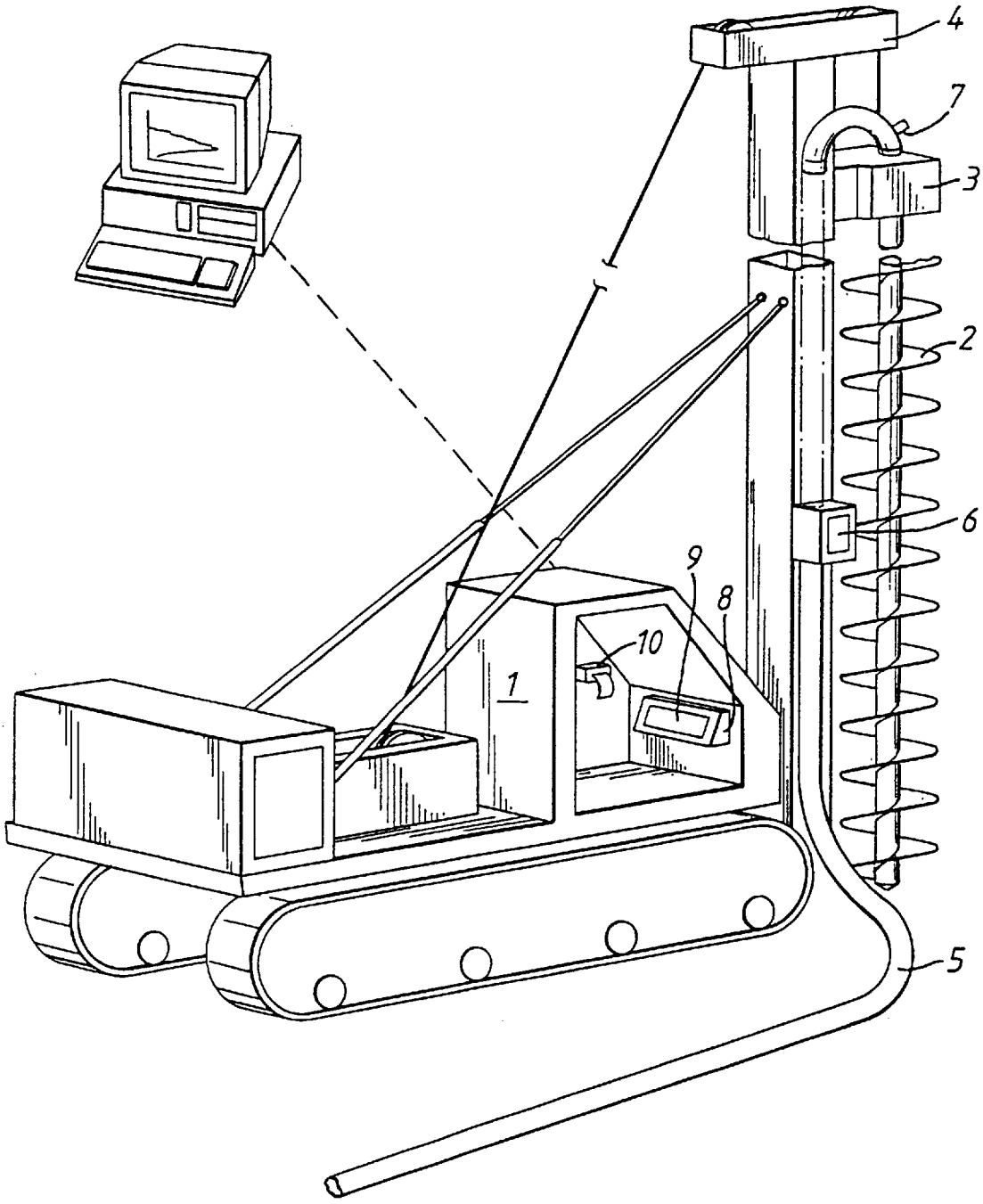
FIGS. 1 and 2 show a continuous flight auger piling rig.
Figure 2:
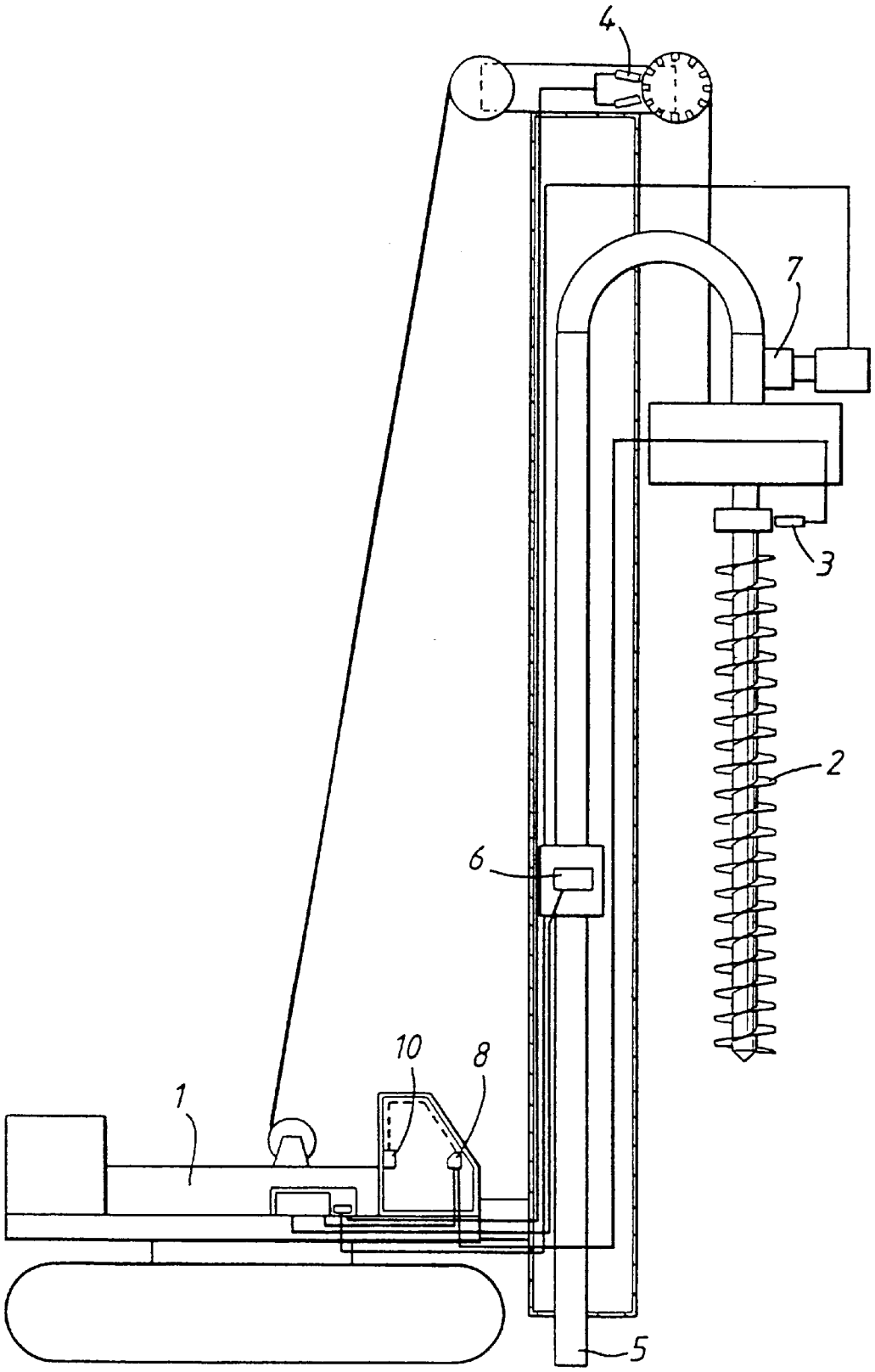

FIGS. 1 and 2 show a continuous flight auger piling rig 1 including an auger 2. The rig is also provided with a rotation encoder 3 for measuring the speed of rotation of the auger and/or the number of revolutions of the auger and/or the torque applied to the auger. There is also provided a depth encoder 4 for determining the depth of penetration of the auger into the ground. Concrete is supplied through a supply line 5 and the shaft of the auger 2 by way of an electromagnetic flowmeter 6 and a pressure sensor 7. The rotation encoder 3, depth encoder 4, flowmeter 6 and pressure sensor 7 are connected by way of data links to an electronic computer 8, incorporating a display unit 9, mounted in the cap of the rig 1. A printer 10 is connected to the computer 9.

Figure 3:
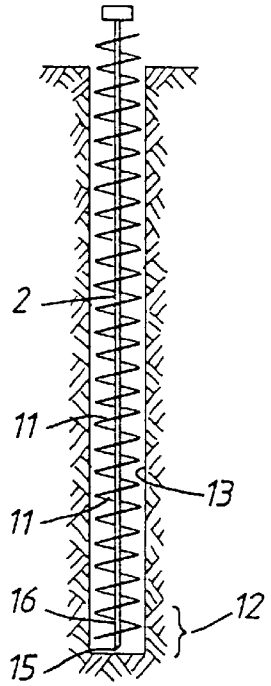
FIG. 3 shows an auger in the penetration phase.

In operation, the rig 1 is operated so that the auger 2 undergoes a first, penetration phase as shown in FIG. 3. In this phase, the auger 2 is rotated and allowed to advance into the ground. Data obtained from the rotation encoder 3 and the depth encoder 4 are processed in the computer 8 so as to control the rotational speed and/or the advance of the auger 2 into the ground as a function of the ground conditions (which may be predetermined and/or monitored by way of the resistance presented to the auger 2 by the ground and other relevant parameters as measured by the rotation encoder 3 and the auger drive (not shown)). The penetration of the auger 2 is controlled so as to ensure that the flights 11 of the auger 2 are kept loaded with soil originating from the region of the auger tip 12. This mode of operation is specified in order to avoid loading of the auger flights 11 with soil from the bore wall 13.

Figure 4:
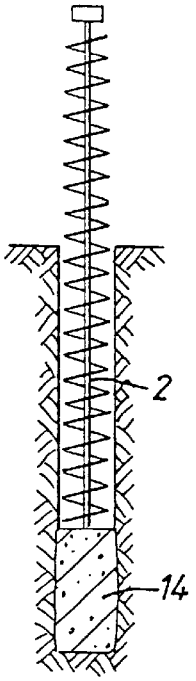
FIG. 4 shows an auger in the withdrawal phase.

Once the auger 2 has advanced to the required depth, as shown in FIG. 4, concrete 14 is pumped through the auger 2 by way of the flow meter 6 and the pressure sensor 7. Once the tip 12 of the auger is immersed in concrete, the auger 2 is progressively withdrawn from the bore by a hydraulic lifting mechanism (not shown) activated by a hydraulic valve (not shown) under the control of the computer 8. The computer 8 is also in communication with the flowmeter 6, and is programmed so as to effect control of the rate of auger withdrawal as a function of the concrete flow rate (or vice versa) so that the auger tip 12 remains immersed in concrete 14 throughout the withdrawal phase. The computer 8 is also programmed so as to halt withdrawal of the auger 2 if the flow of concrete is interrupted.

The concrete outflow at the tip 12 of the auger may be located at the extreme end 15 of the auger shaft or on at a location 16 on the side of the auger shaft just above the extreme end. The latter configuration is preferred, since fewer blockages occur. In the event of a blockage, it is important to keep the bore hole filled while the auger 2 is withdrawn in order to unblock the outflow. This may be done by back-rotation of the auger 2 while back-filling soil at the top of the auger 2; alternatively, a bentonite fluid supplied through a separate feeder pipe (not shown) attached to the auger 2 may be used.

Figure 5:
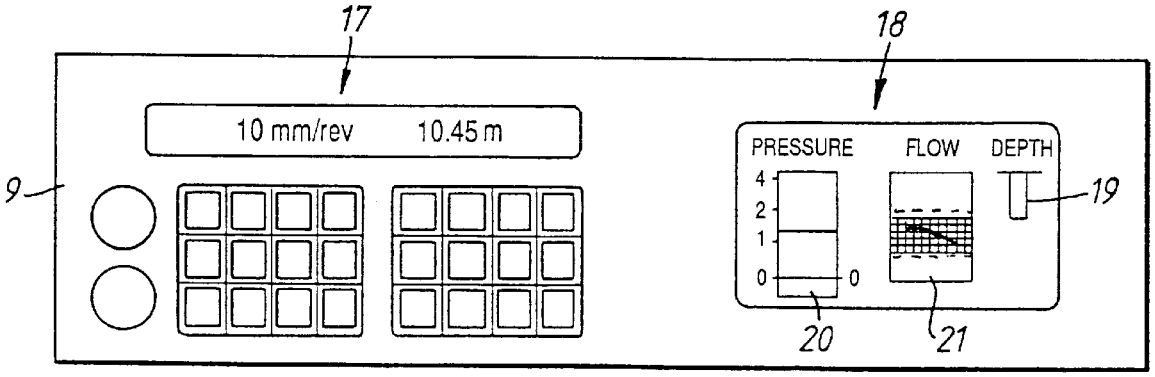
FIG. 5 shows a display unit of the rig of FIGS. 1 and 2.

The display unit 9, shown in more detail in FIG. 5, has two displays. During the penetration phase, the first display 17 shows the penetration of the auger per revolution and the second display 18 shows a graphical representation 19 of the position of the auger 2. The first display 17 shows data (which has been acquired by the computer 8) indicating where the auger 2 penetrates hard ground and gives warning of ground inconsistencies or the possibility of the auger 2 starting to load from the side instead of from the tip 12. During the withdrawal phase, the second display 18 displays data acquired by the computer 8 comprising a continuous record 20 of the concrete pressure measured by the pressure sensor 7, a record 21 of the concrete flow as measured by the flowmeter 6 and compared to a theoretical flow requirement, and a representation 19 of the position of the auger 2. The pressure display 20 indicates the conditions of concrete confinement during injection while the flow display 21 indicates whether the correct volume of concrete 14 or an excess has been supplied.

Data stored in the computer 8, including the data displayed on display unit 9, may be printed out on the printer 10 and/or downloaded directly from the computer 8 to an external computer 80 (shown in FIG. 1) for further analysis.

Figure 6:
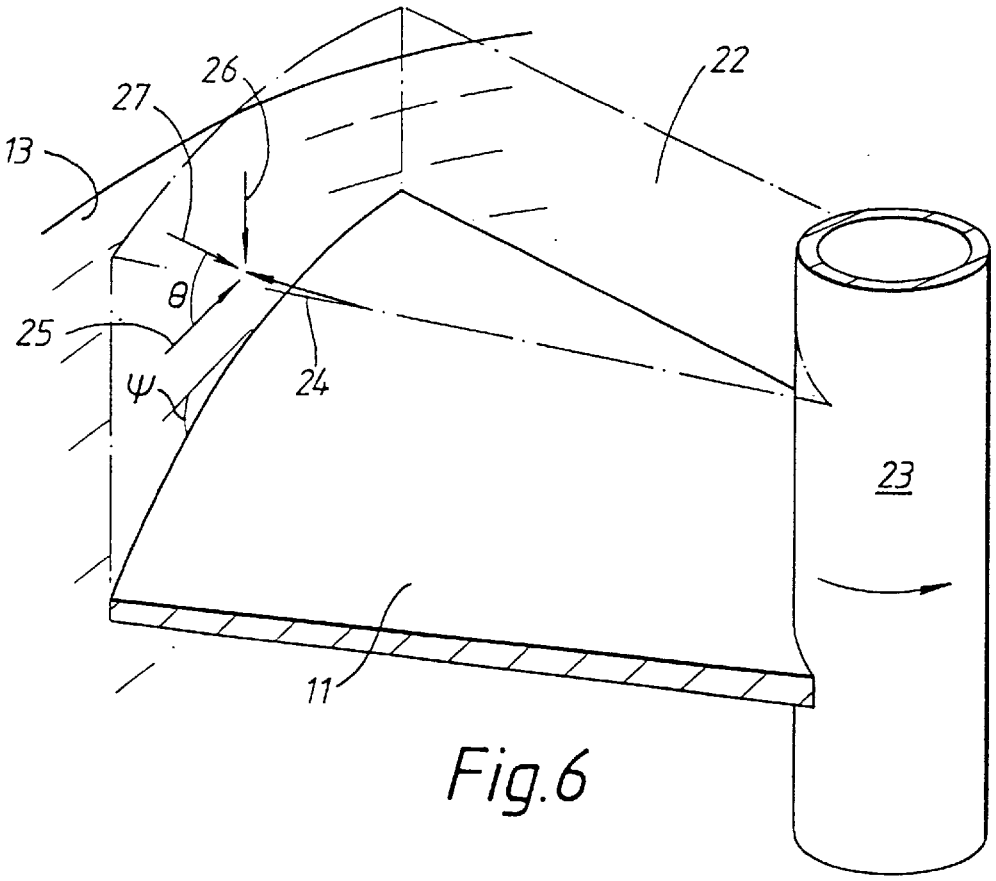
FIG. 6 shows a section of an auger flight in detail.

With reference to FIG. 6, there will now be described a theoretical model for continuous flight boring which illustrates the functional relationships between the various auger parameters required to effect the control provided by an embodiment of the present invention.

In order to understand the action of augers better it is desirable to construct a model of the process. While it should clearly be understood that in variable or multi-layered ground conditions such a model may not be entirely complete, it is nevertheless useful as an aid to understanding the process. The most useful condition to study is that of a cohesionless soil because it is in this condition that the most significant risks lie.

The auger 2 performs two functions in that it cuts or digs the soil 22 and also transports it to the ground surface. These functions may not always be exactly compatible depending on the soil and the auger design and use.

In order to analyze the situation it is necessary at this stage to regard the soil on the auger flights 11 as a continuous ribbon, but it should be recognised that this may not be strictly true because of turbulence within the rising soil mass.

The variables used in the model are as follows:

$\phi$: Angle of soil friction in ground outside the auger $\phi_a$: Angle of friction of disturbed soil on the auger $\delta$: Angle of surface friction of soil to auger $\gamma$: Effective bulk density of soil outside auger $\gamma_a$: Density of 'bulked' soil on the auger flights P: Pitch of auger flights $D_s$: Diameter of auger stem D: External diameter of auger $\theta$: Angle of soil driving friction at the bore perimeter to the horizontal X: Volume of auger metal divided by the volume of the excavated bore for a given length of auger (the auger volume displacement factor).

H: Depth below ground $\psi$: The angle of the flight edge to the horizontal $K_H$: The lateral earth pressure coefficient at the bore wall (after Terzaghi)

S: The penetration rate in turns per meter $T_s$: Shear force at the auger periphery With reference to FIG. 6, the auger stem 23 and its direction of rotation are shown with the edge of the flight 11 running against the effective soil wall 13. The soil element is acted upon by a radial force 24 at the auger periphery which is assumed to be equal to the active earth force from the soil outside the auger 2 (i.e. the force necessary to keep the bore wall 13 in equilibrium). There is a horizontal shear force 25 between the soil element and the bore wall 13 and a vertical shear force 26 at the same position cause by the soil rising in the hole. Both of these forces depend on the radial force 24. The resultant of the vertical and horizontal interface forces is represented at 27.

Soil rise in the borehole in relation to any penetration of the auger depends on two considerations:

i) the bulking or dilation of the excavated soil, and ii) the displacement volume of the auger itself. This the rise can be represented for unit length auger penetration as:

$$a \approx \{(\gamma-\gamma_a)/\gamma_a\} \div \{X/(1-X)\} \quad (1)$$

The peripheral horizontal length travelled by a point on the edge of the auger for unit length of auger penetration is: $b=\pi \cdot D \cdot S$ However, because the soil is rising on the auger, the soil element under consideration would be moving in a counter rotational direction if the auger was stationary. It therefore does not travel the distance b as shown above, but instead travels horizontally by:

$$b'=\pi \cdot D \cdot (S-a/P) \quad (2)$$

The angle of drag friction must align itself with and oppose the vectorial resultant motion, hence the angle of its action to the horizontal is:

$$\theta=\tan^{-1}(a/b') \quad (3)$$

Equation (1) implies that there is a limit to the penetration rate, beyond which to screw the auger into the ground would mobilise forces analogous to 'bearing capacity' and extremely high torques would be required exceeding those available from conventional machines.

Equation (2) implies that the forces acting on the chosen soil element depend on auger diameter, penetration turns per unit length and on the pitch of the auger flights 11.

Once the soil has suffered the effects of auger displacement and bulking, these actions cease and the soil is forced bodily upwards by the effects occurring close to the point at the same general rate.

In practice, trial calculations indicate that the angle of the soil driving force θ moves only a few degrees above the horizontal even for large auger flight pitch values.

The driving force derives from the radial pressure acting to close the hole and a reasonable approach towards finding this is that given by Terzaghi in Theoretical Soil Mechanics (Wiley, N.Y., 1944) for pressures acting on the walls of a shaft. These are forces which represent the minimum valve necessary to sustain the wall.

Figure 7:
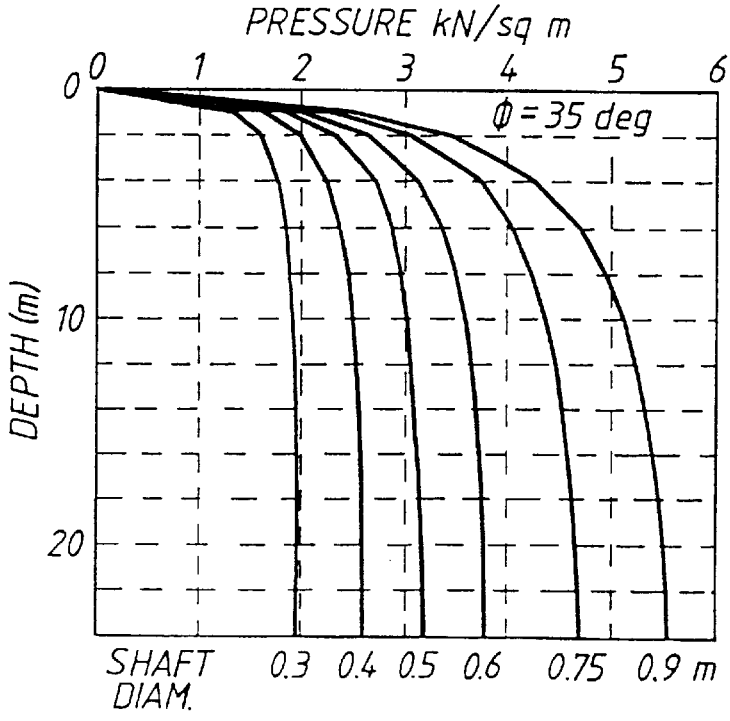
FIGS. 7 and 8 are graphs of lateral soil pressure against depth for various auger shaft sizes soils with different angles of friction.

FIG. 7 shows typical lateral pressures in relation to depth for various shaft sizes in a sand with an angle of friction of 35°. It will be noted that for a small diameter shaft the pressures rapidly approach a near constant value with depth and the stability of the bore wall 13 is easier to maintain than in the case of a larger shaft. Also, the lateral force acting to drive soil up the auger is diminished as the shaft size is reduced.

Figure 8:
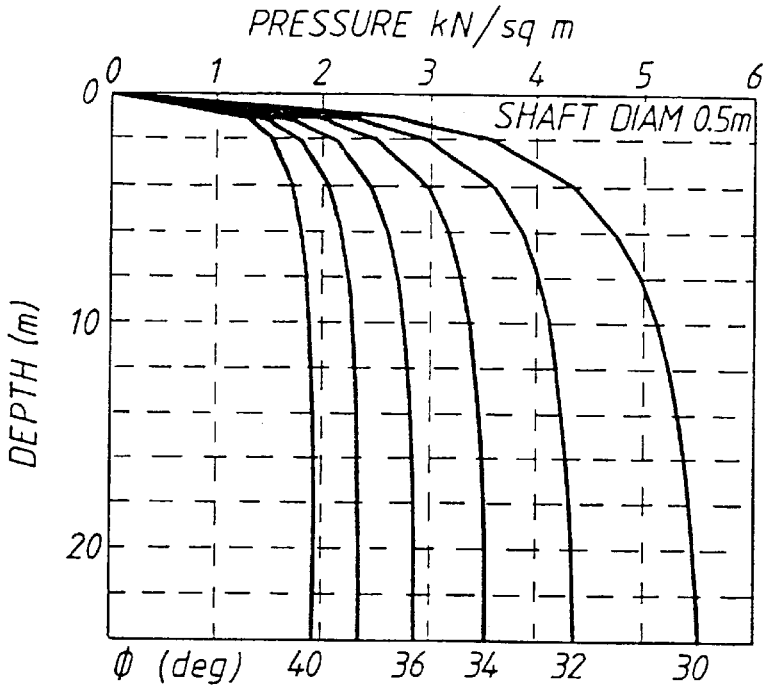

FIG. 8 shows the effect of a change of the angle of friction of the soil mass outside the auger on the lateral pressure as depth increases for a 500 mm pile shaft. Again it may be noted that loose sands with an angle of friction of, say, 30° give rise to larger lateral forces than dense sand. There are therefore greater fores available to drive soil up a continuous flight auger in the loose sand.

Hence large diameter augers and loose sands are likely to give rise to much greater problems than dense sands and small augers in that both the stability of the hole is more difficult to sustain and the transportation driving forces are greater. In view of the magnitude of the pressures, it may be advantageous to feed water into piles bored with this type of equipment. Small water head differences between the inside of the bore and the soil outside will have a marked influence on stability in difficult ground.

The values illustrated for lateral pressure in boreholes in FIGS. 7 and 8 may be confirmed in practice by the use of about 1 m of differential pressure head in pile bores where construction is carried out using bentonite suspension.

Considering now the force acting at the bore wall 13 on the element of soil filling one turn on the auger 2 between the soil on the flight 11 and the soil outside as indicated in FIG. 6:

$$T_s=\pi \cdot D \cdot P \cdot K_H \cdot \tan \phi_a \quad (4)$$

acting at the angle θ.

This is the only driving force acting at the auger flight edge, ignoring any upward force generated remotely at the auger tip 12 by soil coming on to the auger tip.

The weight of soil on one turn of flight is:

$$W=\pi \cdot D^2 \cdot P \cdot \gamma_a \cdot (1-X) \quad (5)$$

Considering now the forces acting up and down the surface of the auger flight 11 and remembering that the effective fores relating to soil weight have to be considered at their centroid on the flight 11 where the slope angle is now corrected from ψ to ψ by purely geometrical considerations taking into account the diameter of the auger stem $D_s$:

| | |
|---|---|
| Down plane forces- Due to self weight: | $W.\sin\psi'$ |
| Due to normal force caused by $T_s$: | $T_s.\sin(\psi' + \theta) .\tan\delta_a$ |
| Due to friction on auger surface: | $W.\cos\psi'.\tan\delta_a$ |

Thus the total force acting down the plane of the auger is:

$$Q_1=W \cdot \sin \psi'+T_s \cdot \sin(\psi'+\theta) \cdot \tan \delta_a+W \cdot \cos \psi' \cdot \tan \delta_a \quad (6)$$

Opposing this, the force acting up the plane of the auger is:

$$Q_2=T_s \cdot \cos (\psi'+\theta) \quad (7)$$

There may be some small force acting also on the underside of the flight 11 depending on whether the soil is packed into it tightly, but this is likely to be small.

Figure 9:
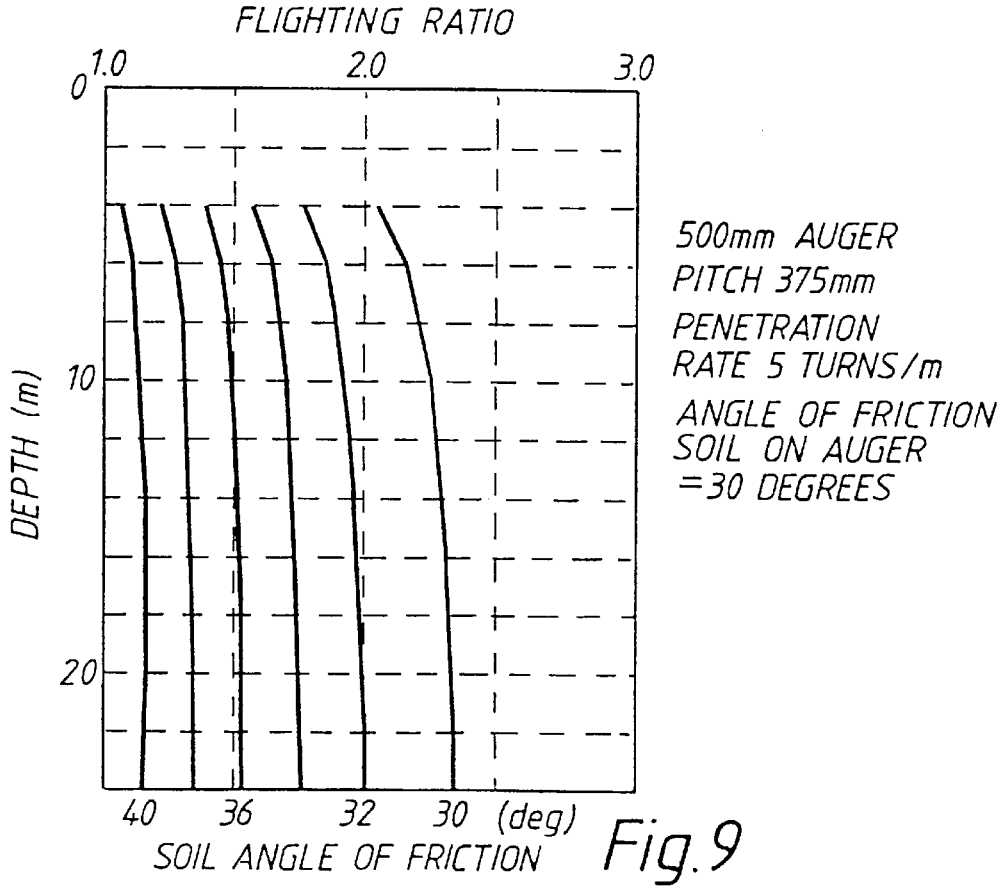
FIG. 9 is a graph of flighting ratio against depth.

The ratio $Q_2/Q_1$ is a ratio between opposing forces, and for convenience will be called the Flighting Force Ratio ($F_R$). The auger would be expected to transport soil so long as ($F_R$) exceeds unity; and given that the ratio is greater than 1.0, the magnitude of the ratio (or excess force) would represent the potential to do work in transporting soil. The relation of Flighting Force Ratio to depth for a specific care is shown in FIG. 9.

An auger 2 turning with no peripheral friction would not transport soil and would therefore be very inefficient. An auger 2 in a soil with a very high angle of friction would have little lateral pressure available from the soil and would be an ineffective transporter. However an auger 2 in a loose sand has a high lateral soil pressure exerted and will be efficient. Therefore, if its penetration rate is not fast enough to keep it fully loaded from the digging action at the base 12, it will load by inward failure of the bore wall 13 and consequently cause considerable ground disturbance in the immediate vicinity.

These are simple considerations and there are additional possible forces on the undersides of auger flights 11 and on the stem. The analysis above treats these issues as potentially minor items and it should be regarded as only indicating the general trends of probable behaviour. Furthermore, turbulence of the soil within the auger is likely to decrease the transporting efficiency.

Based on a study of the flighting ratios from this simple model it is possible to formulate some general propositions on the process of transportation of soil on continuous flight augers:

i) the occurrence of excessive flighting is more likely with large than with small diameter augers;

ii) flighting of soil becomes more difficult as the flight angle is steepened; and iii) excessive flighting becomes less probable as the angle of friction of the soil external to the auger increases.

It may therefore be expected that the detrimental effects of drawing excessive soil into the bore will be most significant when the angle of friction of the surrounding soil corresponds to a loose to medium dense state. In these circumstances the worst effects of side loading can only be avoided by increasing the rate of auger penetration so that the digging and transporting mechanisms are brought into balance. Thus in loose sands where the digging is easy, the penetration rate should be increased, while in dense sands it should be limited. The power of the machine used should always be sufficient; low powered machines are not suitable for many sandy ground conditions. Embodiments of the present invention control penetration rates by linking them directly with the torque being supplied by the driving motor.

With regard to the concreting stage, the auger may be rotated during extraction and concrete placing or may simply be pulled without rotation in sandy soils. If rotation is used there is the possibility that some lateral loading will take place in sands depending on the over-supply of concrete which is imposed.

During the concreting phase with embodiments of the present invention where the supply can be monitored to an accuracy of better than ±5%, a target for over-supply in the region of ±20% may be set. The pressures required to expand a pile shaft in sand at depth are large because of the large passive pressures which can be mobilised in a circular hole, and such pressures are not normally available from a conventional concrete pump. The object of over-supplying is in this case only to ensure that concrete rises relative to the auger 2 at all times.

Under-supply would be a hazard to the proper formation of a pile shaft if it should occur when there has been no reserve of clean concrete taken up onto the main body of the auger 2 above the tip 12.

If auger rotation during withdrawal is used it is clear that if the supply rate is insufficient and the auger transporting rate is not satisfied by it, then side loading can also take place in sand at this stage. In practice some rotation is necessary when concrete flow is initiated in order to clear debris away from the auger tip 12 but it is desirable that thereafter the auger 2 is simply pulled without rotation. If for some reason that is not possible then a very low rotation rate should be applied during the process.

It is also important to consider the initiation of the concrete flow at the base of a pile. The depth encoder 4 can measure to within an accuracy of ±25 mm so that it is possible to observe in detail that sufficient concrete has been carried up onto the auger 2 and that a good positive pressure is present before lifting commences. This has beneficial effects in that i) any void which may have occurred within the auger stem while the machine was moving between piles is eliminated, and ii) that concrete is carried up by, say, 0.5 m in the pile in order to ensure that any loose debris is taken well away from the pile base. In order to achieve this it is necessary to rotate the auger 2 at this stage.

Another problem which is encountered in the initiation of concrete flow concerns the occurrence of blockages. In order to ameliorate this problem it is necessary to use a concrete mix with good flow characteristics and a slump of 150 mm is normally adopted. It has also been found that attention needs to be paid to the water tightness of the bung and to its position.

The concrete supply pressure is usually measured at the top of the auger stem. If it is measured elsewhere lower down on the supply side then there will be an offset to the pressure delivery record. The pressure available at the delivery point at the auger tip 12 needs to have the pressure due to the head of concrete within the auger stem added so long as the measured pressure is above minus one atmosphere. Over most of the length of a pile, positive pressures would be expected at the auger head. However, as the auger tip 12 approaches the ground and, if at that stage it is loaded with sand, then there may come a point where, though the auger 2 may still be embedded by several meters, the concrete escapes to the ground surface. At this point pressure measurement becomes meaningless and only concrete flow is then relevant. The concrete may escape to the ground surface by a mechanism similar to hydrofracture and it may pass up the underside of the flights to flow from the top of the bore.

A preferred regime in concreting continuous flight augered piles is therefore to rotate the auger in the initial stages of concrete pumping in order to carry concrete up onto the auger and thereafter to cease rotation for the remainder of the extraction or to permit rotation throughout the lifting process only at a low or the lowest available speed.

In clay soils, most of the problems discussed above with reference to sand do not normally exist, provided the clays are stiff and self-stable, but some difficulties are apparent, particularly with regard to soft clays and clayey silts.

In general, the concrete pressure is monitored at the auger head in the supply line 5. When the pressure is zero at this position, then normally the pressure at the delivery point corresponds to the length of the auger 2, less a little allowance for friction. This pressure alone (minus one atmosphere if pumping is ceased) may be more than sufficient to cause borehole expansion. Thus, for example, if the clay surrounding the auger tip 12 has an undrained shear strength of $30kN/m^2$, a pressure of about $200kN/m^2$ would be necessary to expand the borehole. If the auger stem is, say, 25 m long, the available pressure at the auger tip may be of the order of $600-100=500kN/m^2$. Therefore, since the available pressure is more than twice that necessary to cause expansion, the auger 2 could be parked and continuous pumping would be possible without apparent resistance even if there is no easy path for the concrete to escape to ground level. Extracted piles constructed through soft clays where concrete has been over supplied confirm that the pile sections can be significantly oversized. This may not be of great consequence in most cases, although it may cause ground heave, but where negative friction or downdrag is expected it can lead to increased effective pile loads.

On the other hand, in stiff clays, and if the auger is fully loaded or blocked with clay so that escape of concrete to the ground surface is prevented, then the available pressures from the supply pump may be insufficient to expand the bore and it may not be possible to achieve an over-supply target which may have been set. Prolonged periods of high pressure in the supply line may lead to blockage of the supply if there is any small leakage at joints in the pipe work. In circumstances where over-supply cannot be achieved it may be best to monitor events and accept that any pre-set target for delivery cannot be met.

The examination of the process of forming continuous flight auger piles above indicates that the risks attached to the construction process in sandy soils are two-fold. Firstly over digging and the loosening of soil is liable to lead to ground subsidence if not controlled and it can affect neighbouring properties which are not well founded. Secondly, the disturbance effects on the adjacent ground lead to reduced shaft friction by comparison with the methods used in the formation of other types of bored pile.

what is claimed is:

1. A method of continuous flight auger piling, comprising the steps of:

i) applying an auger to the ground so as to undergo a first, penetration phase and a second, withdrawal phase wherein one or more of (a) a rotational speed of the auger, (b) a rate of penetration of the auger, and (c) a torque applied to the auger during the first, penetration phase are determined and controlled as a function of the ground conditions and the auger geometry by means of an electronic computer so as to tend to keep the auger flights loaded with soil originating from the region of the tip of the auger;

ii) supplying concrete to the tip of the auger during the second, withdrawal phase by way of flow control and measuring means wherein the rate of withdrawal of the auger is controlled as a function of the flow rate of the concrete, or vice versa, by means of an electronic computer so as to ensure that sufficient concrete is supplied to keep at least the tip of the auger immersed in concrete during withdrawal.

2. A method according to claim 1, further comprising steps of driving the auger so as to penetrate the ground to a predetermined depth, and arresting the advance of the auger at the predetermined depth so as to allow shearing of soil surrounding the bore wall to take place.

3. A method according to claim 1, further comprising repeating the penetration and an arrest of the penetration until the auger has reached a predetermined depth.

4. A method according to claim 1, further comprising a step of arranging the electronic computer to control the advance of the auger so as to achieve a predetermined number of auger revolutions per unit depth of penetration.

5. A method according to claim 1, further comprising a step of determining the maximum torque available to drive the auger and arresting the advance of the auger when the torque applied to the auger reaches a predetermined level at or near the maximum determined level.

6. A method according to claim 1, further comprising a step of supplying at least 5% more concrete than that theoretically required to fill a cylinder of the diameter and length of the bore.

7. A method according to claim 6, further comprising a step of supplying 10% to 35% more concrete than that theoretically required to fill a cylinder of the diameter and length of the bore.

8. A method according to claim 1, further comprising a step of withdrawing the auger by way of a hydraulic rig incorporating an electronically controlled hydraulic valve operated by the electronic computer.

9. A method of continuous flight auger piling, comprising the step of applying an auger to the ground so as to undergo a first, penetration phase and a second, withdrawal phase wherein one or more of (a) a rotational speed of the auger, (b) a rate of penetration of the auger, and (c) a torque applied to the auger during the first, penetration phase are determined and controlled as a function of the ground conditions and auger geometry by means of an electronic computer so as to tend to keep the auger flights loaded with soil originating from the region of the tip of the auger.

10. A method according to claim 9, further comprising steps of driving the auger so as to penetrate the ground to a predetermined depth, and arresting the advance of the auger so as to allow shearing of soil surrounding the bore wall to take place.

11. A method according to claim 9, further comprising repeating the penetration and an arrest of the penetration until the auger has reached a predetermined depth.

12. A method according to claim 9, further comprising a step of arranging the electronic computer to control the advance of the auger so as to achieve a predetermined number of auger revolutions per unit depth of penetration.

13. A method according to claim 9, further comprising steps of determining the maximum torque available to drive the auger and arresting the advance of the auger when the torque applied to the auger reaches a predetermined level at or near the maximum determined level.

14. A method of continuous flight auger piling, comprising the steps of:

i) applying an auger to the ground so as to undergo a first, penetration phase and a second, withdrawal phase;

ii) supplying concrete to the tip of the auger during the second, withdrawal phase by way of an electromagnetic flowmeter and flow control means wherein the rate of the withdrawal of the auger is controlled as a function of a flow rate of the concrete, or vice versa, by means of an electronic computer so as to ensure that sufficient concrete is supplied to keep at least the tip of the auger immersed in concrete during withdrawal.

15. A method according to claim 14, further comprising a step of supplying at least 5% more concrete than that theoretically required to fill a cylinder of the diameter and length of the bore.

16. A method according to claim 15, further comprising a step of supplying 10% to 35% more concrete than that theoretically required to fill a cylinder of the diameter and length of the bore.

17. A method according to claim 16, further comprising a step of withdrawing the auger by way of a hydraulic rig incorporating an electronically controlled hydraulic valve operated by the electronic computer.

18. A continuous flight auger rig comprising an auger, means for diving the auger into the ground, means for measuring and controlling at least one of (a) a rotational speed of the auger, (b) a rate of penetration of the auger, and (c) a torque applied to the auger as it penetrates the ground, electronic computer means for controlling at least one of (a) the rotational speed of the auger, (b) the rate of penetration of the auger, and (c) the torque applied to the auger as a function of the ground conditions and auger geometry so as to tend, in use, to keep the auger flights loaded with soil originating from the region of the tip of the auger, means for withdrawing the auger from the ground, means for supplying concrete to the tip of the auger during withdrawal, means for measuring and controlling the supply to the ground, and electronic computer means for controlling the auger during the withdrawal phase of its operation so as to ensure that at least the tip of the auger remains immersed in concrete during withdrawal.

19. A continuous flight auger rig comprising an auger, means for driving the auger into the ground, means for measuring and controlling at least one of (a) a rotational speed of the auger, (b) a rate of penetration of the auger, and (c) a torque applied to the auger as it penetrates the ground, and electronic computer means for controlling at least one of (a) the rotational speed of the auger, (b) the rate of penetration of the auger, and (c) the torque applied to the auger as a function of the ground conditions and the auger geometry so as to tend, in use to keep the auger flights loaded with soil originating from the region of the tip of the auger.

20. A continuous flight auger rig comprising an auger, means for driving the auger into the ground, means for withdrawing the auger from the ground, means for supplying concrete to the tip of the auger during withdrawal, means for controlling the supply of concrete to the ground, an electromagnetic flowmeter for measuring the volume of concrete supplied, and electronic computer means for controlling the auger during at least the withdrawal phase of its operation so as to ensure that at least the tip of the auger remains immersed in concrete during withdrawal.

* * * * *